US009437918B1

(12) United States Patent
Bales et al.

(10) Patent No.: US 9,437,918 B1
(45) Date of Patent: Sep. 6, 2016

(54) ANTENNA MOUNTING BRACKET WITH ADJUSTABLE AZIMUTH SETTINGS

(71) Applicant: SPRINT COMMUNICATION COMPANY L.P., Overland Park, KS (US)

(72) Inventors: Stephen R. Bales, Lee's Summit, MO (US); Noel M. Hansen, Maryland Heights, MO (US); Greg Nohalty, Overland Park, KS (US); Maneesh Gauba, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 361 days.

(21) Appl. No.: 14/164,499

(22) Filed: Jan. 27, 2014

(51) Int. Cl.

| | |
|---|---|
| ***H01Q 1/12*** | (2006.01) |
| ***H01Q 3/04*** | (2006.01) |
| *H01Q 1/00* | (2006.01) |
| *H01Q 3/00* | (2006.01) |

(52) U.S. Cl.
CPC ..... *H01Q 1/125* (2013.01); *H01Q 3/04* (2013.01)

(58) Field of Classification Search
CPC ..... H01Q 1/12; H01Q 1/125; H01Q 3/02; H01Q 3/04; H01Q 1/1207; H01Q 1/1221; H01Q 1/1228; H01Q 1/1264; H01Q 3/08
USPC ..... 343/350, 359, 700 R, 757–766, 878–892
See application file for complete search history.

(56) References Cited

U.S. PATENT DOCUMENTS

| | | | | |
|---|---|---|---|---|
| 5,945,961 | A * | 8/1999 | Price | H01Q 1/125 343/882 |
| 6,037,913 | A * | 3/2000 | Johnson | H01Q 3/02 343/882 |
| 6,195,066 | B1 * | 2/2001 | Pegues, Jr. | H01Q 1/125 343/878 |
| 6,445,361 | B2 * | 9/2002 | Liu | 343/878 |
| 6,480,161 | B2 * | 11/2002 | Watson | H01Q 3/02 343/758 |
| 6,850,202 | B2 * | 2/2005 | Watson | H01Q 3/02 343/766 |
| 7,050,012 | B2 * | 5/2006 | Chen | H01Q 1/125 343/757 |
| 7,408,526 | B2 * | 8/2008 | Pan | H01Q 1/125 343/880 |
| 7,456,802 | B1 * | 11/2008 | Bourgeois | H01Q 1/1221 343/878 |
| 8,378,918 | B2 * | 2/2013 | Sherwood | H01Q 3/08 343/882 |
| 8,451,187 | B2 * | 5/2013 | Zihlman | H01Q 3/08 343/882 |
| 2013/0120202 | A1 | 5/2013 | Lever et al. | |

* cited by examiner

*Primary Examiner* — Bernarr Gregory

(57) ABSTRACT

An antenna mounting bracket with adjustable azimuth settings and a method and medium for using the antenna mounting bracket are provided. The antenna mounting bracket includes a fixed bracket assembly coupled to a support structure, and a movable bracket assembly to which an antenna is mounted. The movable bracket assembly is rotatably coupled to the fixed bracket assembly by a pivot rod. Locking pins associated with the fixed bracket assembly can be used to reversibly secure the movable bracket assembly at a certain azimuth. A gearbox assembly associated with the movable bracket assembly can be actuated to angularly rotate the movable bracket assembly a predetermined number of degrees relative to the pivot rod when the movable bracket assembly is not secured to the fixed bracket assembly by the locking pins. Rotation of the movable bracket assembly causes the mounted antenna to angularly rotate to a new azimuth.

20 Claims, 11 Drawing Sheets

ANTENNA MOUNTING BRACKET WITH ADJUSTABLE AZIMUTH SETTINGS

SUMMARY

A high level overview of various aspects of the invention is provided here for that reason, to provide an overview of the disclosure and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief, and at a high level, this disclosure describes, among other things, an antenna mounting bracket with adjustable azimuth settings that is used for mounting an antenna to a support structure such as, for example, a base station tower. The antenna mounting bracket can be automatically and without human intervention switched to different azimuth settings thereby changing the azimuth of the attached antenna. The ability to remotely regulate the azimuth of the antenna eliminates the need to send a work crew out to the support structure in the event that the azimuth of the antenna needs to be changed to achieve, for instance, a different cell coverage pattern.

The antenna mounting bracket generally comprises a fixed bracket assembly coupled to the support structure and a movable bracket assembly rotatably coupled to the fixed bracket assembly via a pivot rod. An antenna, in turn, is securely attached to the movable bracket assembly. The fixed bracket assembly includes locking pins that are movable between a first engaged position and a second disengaged position. The movable bracket assembly includes receiving apertures adapted to receive the locking pins when the locking pins are in the first engaged position, thereby fixing the movable bracket assembly in place. When the locking pins are moved to the second disengaged position (e.g., disengaged from the receiving apertures), the movable bracket assembly can be made to angularly rotate through a predetermined number of degrees relative to the pivot rod via, for example, a gearbox assembly. Once the antenna is positioned at the new azimuth setting, the movable bracket assembly is fixed in position by the engagement of the locking pins with the receiving apertures of the movable bracket assembly.

BRIEF DESCRIPTION OF THE DRAWINGS

Illustrative embodiments of the present invention are described in detail below with reference to the attached drawings figures, and wherein.

DETAILED DESCRIPTION

Figure 1:
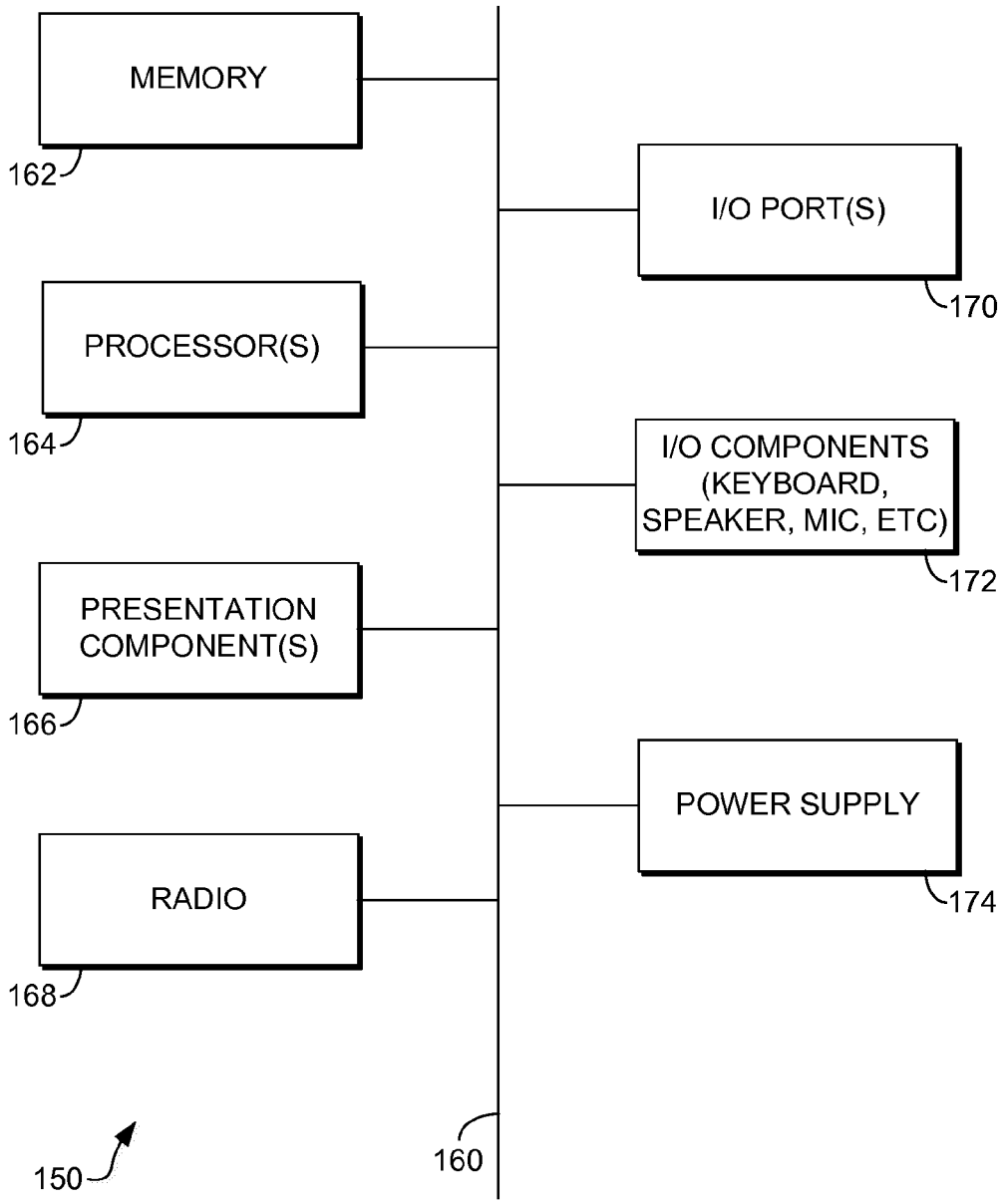
FIG. 1 depicts an exemplary computing device according to an embodiment of the technology.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Throughout this disclosure, acronyms and shorthand notations may be used to aid the understanding of certain concepts pertaining to the associated system and services. These acronyms and shorthand notations are intended to help provide an easy methodology of communicating the ideas expressed herein and are not meant to limit the scope of the present invention. Further, various technical terms are used throughout this description. An illustrative resource that fleshes out various aspects of these terms can be found in Newton's Telecom Dictionary, 27th Edition (2013).

Embodiments of the present invention may be embodied as, among other things, a method, system, or set of instructions embodied on one or more non-transitory computer-readable or computer-storage media. Computer-readable media comprises physical storage devices and include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to computer-storage media such as information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Examples of the present invention are directed towards an antenna mounting bracket having adjustable azimuth settings. The antenna mounting bracket is used to attach an antenna to a support structure such as, for example, a base station tower. The antenna mounting bracket comprises a fixed bracket assembly fixedly coupled to the support structure and including at least a set of locking pins that is movable from a first engaged position to a second disengaged position and vice versa. The antenna mounting bracket further comprises a movable bracket assembly that is rotatably coupled to the fixed bracket assembly via a pivot rod and to which the antenna is securely mounted. The movable bracket assembly includes a set of receiving apertures adapted to receive the locking pins of the fixed bracket assembly such that when the locking pins are engaged with the receiving apertures, the movable bracket assembly is fixed in position at a certain azimuth setting, and when the locking pins are disengaged from the receiving apertures, the movable bracket assembly is able to angularly rotate a certain number of degrees to a new azimuth setting, thereby causing the attached antenna to rotate to the new azimuth setting. The angular rotation of the movable bracket assembly is effectuated by a moving means such as a gearbox assembly that is mechanically coupled to the movable bracket assembly. The gearbox assembly actuates the angular rotation of the movable bracket assembly relative to the pivot rod and the fixed bracket assembly.

Examples of the present invention are also directed to computer-readable media and systems for remotely changing the azimuth setting of an antenna using the antenna mounting bracket with adjustable azimuth settings described above. A new azimuth setting may be determined for the antenna in order to, for example, establish a different cell phone coverage pattern. The locking pins of the fixed bracket assembly are disengaged from the receiving apertures of the movable bracket assembly via, for instance, the application of a current to an electromagnet positioned adjacent to the locking pins. Once the locking pins are disengaged from the receiving apertures, the gearbox assembly or moving means is actuated for a predetermined period of time, and the movable bracket assembly is angularly rotated in a first direction relative to the pivot rod to the new azimuth setting. When the movable bracket assembly is at the new azimuth setting, the electrical current is no longer applied to the electromagnet which causes the locking pins to be released from the electromagnet. Upon release, the locking pins are received by the receiving apertures of the movable bracket assembly thereby fixing the antenna at the new azimuth setting.

Accordingly, in a first aspect, an antenna mounting bracket with adjustable azimuth settings is provided. The antenna mounting bracket comprises a fixed bracket assembly coupled to a support structure. The fixed bracket assembly comprises at least a set of locking pins movable from a first engaged position to a second disengaged position. The antenna mounting bracket further comprises a movable bracket assembly rotatably coupled to the fixed bracket assembly via a pivot rod. The movable bracket assembly comprises at least a set of receiving apertures adapted to receive the set of locking pins when the locking pins are in the first engaged position and a gearbox assembly having a plurality of gears coupled to a motor. Actuation of the gearbox assembly rotates the movable bracket assembly relative to the pivot rod along a predetermined angular range of motion on a horizontal plane when the set of locking pins is in the second disengaged position.

In a second aspect, the antenna mounting bracket comprises a movable bracket assembly adapted to angularly rotate through one or more predetermined azimuth settings; the movable bracket assembly comprises at least a set of receiving apertures. The antenna mounting bracket further comprises a fixed bracket assembly that is fixedly coupled to the support structure and rotatably coupled to the movable bracket assembly via a pivot rod. The fixed bracket assembly comprises one or more locking pins movable from a first engaged position to a second disengaged position. The one or more locking pins are vertically adjacent to the set of receiving apertures of the movable bracket assembly. When the one or more locking pins are in the first engaged position, they are received by the set of receiving apertures such that the movable bracket assembly is held in a fixed position. When the one or more locking pins are in the second disengaged position, the movable bracket assembly is able to angularly rotate through the one or more predetermined azimuth settings relative to the pivot rod.

In a third aspect, a computerized method is carried out by at least one server having at least one processor for automatically and without human intervention changing an azimuth setting of an antenna mounted to a support structure using an antenna mounting bracket. The antenna mounting bracket comprises a fixed bracket assembly fixedly coupled to the support structure and rotatably coupled to a movable bracket assembly via a pivot rod. The fixed bracket assembly comprises at least a set of movable locking pins, and the movable bracket assembly comprises at least a set of receiving apertures adapted to receive the set of locking pins when the set of locking pins is in a first engaged position. The antenna is fixedly coupled to the movable bracket assembly. The method comprises determining a second azimuth setting for the antenna, where the antenna is currently at a first azimuth setting. The set of locking pins is actuated to transition the set of locking pins from the first engaged position to a second disengaged position such that the set of locking pins is no longer received by the set of receiving apertures. A gearbox assembly mechanically coupled to the movable bracket assembly is actuated for a predetermined period of time such that the movable bracket assembly is angularly rotated in a first direction relative to the pivot rod to the second azimuth setting. The set of locking pins is actuated to transition the set of locking pins from the second disengaged position to the first engaged position thereby fixing the antenna at the second azimuth setting.

Turning now to FIG. 1, a block diagram of an illustrative computing device is provided and is referenced generally by the numeral 150. Although some components are shown in the singular, they may be plural. For example, the computing device 150 might include multiple processors or multiple radios, etc. As illustratively shown, the computing device 150 includes a bus 160 that directly or indirectly couples various components together including memory 162, a processor 164, a presentation component 166, a radio 168, input/output ports 170, input/output components 172, and a power supply 174.

The memory 162 might take the form of memory components previously described. Thus, further elaboration will not be provided here, only to say that the memory component 162 can include any type of medium that is capable of storing information (e.g., a database). A database can be any collection of records. In one embodiment, the memory 162 includes a set of embodied computer-executable instructions that, when executed, facilitates various aspects disclosed herein. These embodied instructions will variously be referred to as "instructions" or an "application" for short.

The processor 164 might actually be multiple processors that receive instructions and process them accordingly. The presentation component 166 includes the likes of a display, a speaker, as well as other components that can present information (such as a lamp (LED), or even lighted keyboards).

The radio 168 facilitates communication with a wireless-telecommunications-network. Illustrative wireless-telecommunications technologies include CDMA, EvDO, GPRS, TDMA, GSM, WiMax technology, LTE, LTE Advanced and the like. In some embodiments, the radio 168 might also facilitate other types of wireless communications including Wi-Fi®, Bluetooth® communications, GIS communications, and other near-field communications.

As way of background, a typical antenna mounting bracket secures an antenna to a support structure such as a base station tower at a fixed azimuth. As used throughout this disclosure, the term "azimuth" means a horizontal direction expressed as the angular distance between the direction of a fixed point (generally due North) and the direction of the object; the azimuth is measured in degrees. Typically, in order to change the azimuth of the antenna, the base station must be powered down, and a technician must climb the tower and manually change the azimuth setting of the antenna. This process disrupts service to subscribers being served by the antenna, consumes the resources of personnel that may be better employed elsewhere, and costs the telecommunications-network financial resources.

Figure 2:
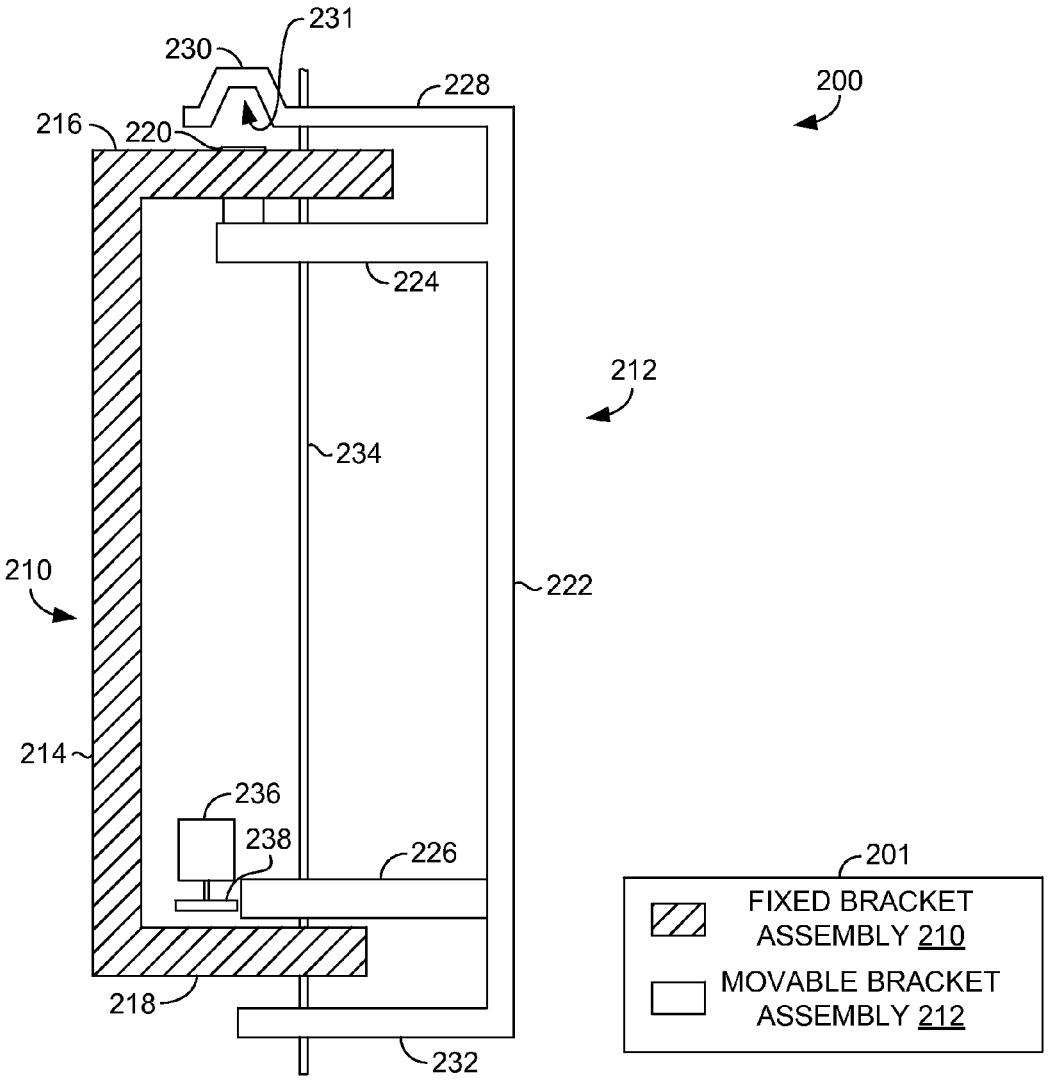
FIG. 2 depicts a side plan view of an exemplary antenna mounting bracket with adjustable azimuth settings suitable for practicing an embodiment of the technology.

Turning now to FIG. 2, a side plan view of an exemplary antenna mounting bracket with adjustable azimuth settings is depicted and is referenced generally by the numeral 200. As indicated by the legend 201, the antenna mounting bracket 200 generally comprises a fixed bracket assembly 210 indicated in FIG. 2 by diagonal slashes and a movable bracket assembly 212. The fixed bracket assembly 210 and the movable bracket assembly 212 may be constructed of durable, non-compressible materials such as, for example, steel, stainless steel, and/or other similar materials.

Addressing the fixed bracket assembly 210 first, as its name implies, the fixed bracket assembly 210 is fixed in position and does not rotate. The fixed bracket assembly 210 comprises a back plate 214, a locking pin plate 216, and a lower plate 218. The back plate 214 is used to securely affix the antenna mounting bracket 200 to a support structure such as, for example, a platform associated with a base station tower. The back plate 214 may be affixed to the support structure by, for instance, welding, adjustable clamps, rivets, screws, and the like. The back plate 214 may be generally square and/or rectangular in shape and have dimensions of approximately 10 inches high by 10 inches wide although other shapes and/or dimensions are contemplated as being within the scope of the invention. The lower plate 218 of the fixed bracket assembly 210 extends perpendicularly inward from the back plate 214 towards the interior of the antenna mounting bracket 200 and includes an aperture through which a pivot rod 234 extends as will be explained more fully below.

The locking pin plate 216 of the fixed bracket assembly 210 also extends perpendicularly inward from the back plate 214 towards the interior of the antenna mounting bracket 200 and generally comprises between three to five movable locking pins 220, one of which is shown in FIG. 2. The movable locking pins 220 extend through the thickness of the locking pin plate 216. As will be explained in greater depth below, the locking pins 220 are movable between a first engaged position and a second disengaged position. In the first engaged position, and as shown in FIG. 2, the head of the locking pin 220 is generally flush with the top surface of the locking pin plate 216, and the pin body extends a distance below the lower surface of the locking pin plate 216 where it is received by a receiving aperture of the movable bracket assembly 212. In the second disengaged position, the head of the locking pin 220 extends a distance above the top surface of the locking pin plate 216, and the lower end of the locking pin 220 is generally flush with the bottom surface of the locking pin plate 216. The locking pin plate 216 also comprises an aperture through which the pivot rod 234 extends. As will be explained below with respect to FIGS. 6-7, the locking pin plate 216 may include either a rotation limiting pin or a rotation limiting channel, either of which in combination with a corresponding rotation limiting channel or a rotation limiting pin respectively associated with the movable bracket assembly 212 may be used to limit the angular rotation of the movable bracket assembly 212.

The movable bracket assembly 212 generally comprises a front plate 222, a receiving plate 224, a rotation actuation plate 226, a locking pin receiving plate 228, and a bottom plate 232. The antenna is securely attached to the front plate 222 by for example, welding, rivets, clamps, screws, and the like. The front plate 222 may be generally square and/or rectangular in shape and have dimensions of approximately 10 inches high by 10 inches wide although other shapes and/or dimensions are contemplated as being within the scope of the invention.

The receiving plate 224 of the movable bracket assembly 212 extends perpendicularly inward from the front plate 222 towards the interior of the antenna mounting bracket 200. The receiving plate 224 is situated vertically beneath the locking pin plate 216 of the fixed bracket assembly 210. The receiving plate 224 generally comprises between 12 to 20 receiving apertures (not shown in FIG. 2). In one aspect, the receiving apertures may extend through the thickness of the receiving plate 224, while in another aspect, the receiving apertures may extend from the top surface of the receiving plate 224 approximately partway through the thickness of the receiving plate 224. Any and all such aspects, and any variation thereof, are contemplated as being within the scope of the invention. The receiving plate 224 also comprises an aperture through which the pivot rod 234 extends. As will be explained below with respect to FIGS. 3-4, the receiving plate 224 may include either a rotation limiting pin or a rotation limiting channel, either of which in combination with a corresponding rotation limiting channel or a rotation limiting pin respectively associated with the fixed bracket assembly 210 may be used to limit the angular rotation of the movable bracket assembly 212.

The rotation actuation plate 226 of the movable bracket assembly 212 extends perpendicularly inward from the front plate 222 towards the interior of the antenna mounting bracket 200. The rotation actuation plate 226 is situated vertically above the lower plate 218 of the fixed bracket assembly 210. The rotation actuation plate 226 includes an aperture through which the pivot rod 234 extends. As well, the rotation actuation plate 226 is mechanically coupled to a moving means that acts to rotate the movable bracket assembly 212 along an angular range of motion in a horizontal plane. In one aspect, and as shown in FIG. 2, the moving means comprises a motor 236 coupled to a gear 238. The gear 238, in turn, is mechanically coupled to the rotation actuation plate 226. This will be explained in greater depth with respect to FIG. 5.

The locking pin receiving plate 228 extends perpendicularly inward from the front plate 222 towards the interior of the antenna mounting bracket 200. The locking pin receiving plate 228 is situated vertically above the locking pin plate 216 of the fixed bracket assembly 210 and includes an aperture through which the pivot rod 234 extends. The locking pin receiving plate 228 further includes an electromagnet 230 for actuating the movement of the locking pins 220 from the first engaged position to the second disengaged position and vice versa. The electromagnet 230 is located vertically above the locking pins 220 of the locking pin plate 216. Upon application of current to the electromagnet 230, the electromagnet 230 becomes magnetized and exerts an upward force on the heads of the locking pins 220 causing them to transition from the first engaged position to the second disengaged position. In the second disengaged position, the heads of the locking pins 220 are retained in a cavity portion 231 of the electromagnet 230. Once the electrical current is discontinued, the electromagnet 230 is no longer magnetic causing the locking pins 220 to be released.

Other mechanisms for moving the locking pins 220 are contemplated as being within the scope of the invention. For example, a vacuum plate in the general shape of the electromagnet 230 may be utilized to exert an upward force on the heads of the locking pins 220 causing them to disengage from the receiving apertures. With respect to this aspect, the vacuum plate may comprise a number of apertures through which the vacuum force is applied. The vacuum plate may be coupled to a vacuum generator that generates the vacuum force. The vacuum force may be generated using traditional vacuum pumps operated by a motor or engine. Or the vacuum force may be generated using, for example, a venturi pump. Any and all such aspects, and any combination thereof, are contemplated as being within the scope of the invention.

The bottom plate 232 of the movable bracket assembly 212 extends perpendicularly inward from the front plate 222 towards the interior of the antenna mounting bracket 200. The bottom plate 232 is situated vertically beneath the lower plate 218 of the fixed bracket assembly 210 and includes an aperture through which the pivot rod 234 extends.

The pivot rod 234 extends respectively from top to bottom through the locking pin receiving plate 228 of the movable bracket assembly 212, the locking pin plate 216 of the fixed bracket assembly 210, the receiving plate 224 of the movable bracket assembly 212, the rotation actuation plate 226 of the movable bracket assembly 212, the lower plate 218 of the fixed bracket assembly 210, and the bottom plate 232 of the movable bracket assembly 212. The pivot rod 234 acts to rotatably couple the movable bracket assembly 212 to the fixed bracket assembly 210. As such, the angular rotation of the movable bracket assembly 212 occurs relative to the pivot rod 234.

Figure 3:
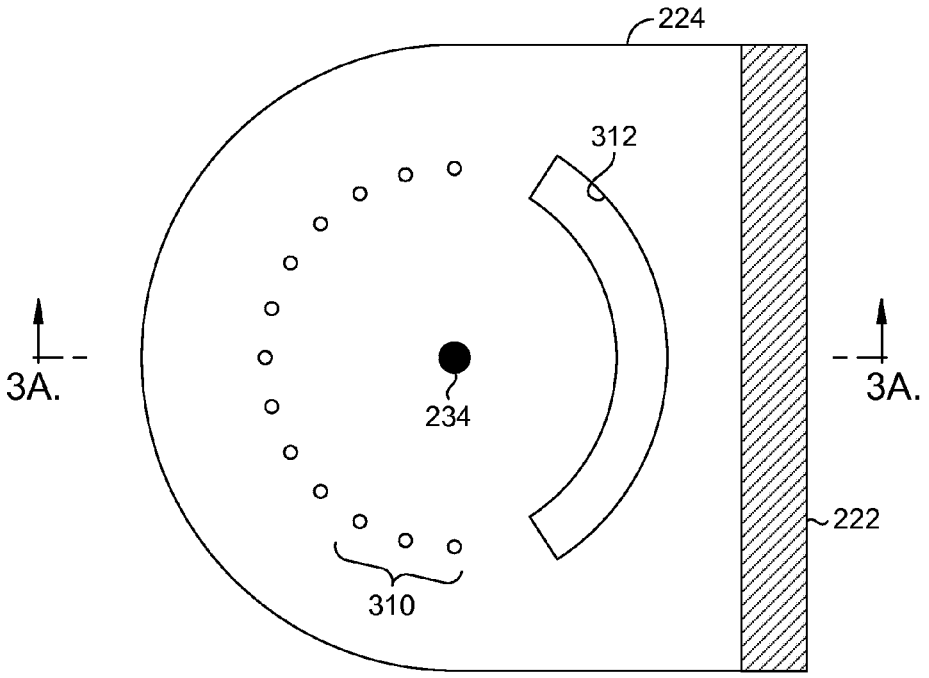
FIG. 3 depicts a top plan view of a receiving plate of an exemplary movable bracket assembly of the antenna mounting bracket of FIG. 2 illustrating a set of receiving apertures and a rotation limiting channel suitable for practicing an embodiment of the technology.
Figure 4:
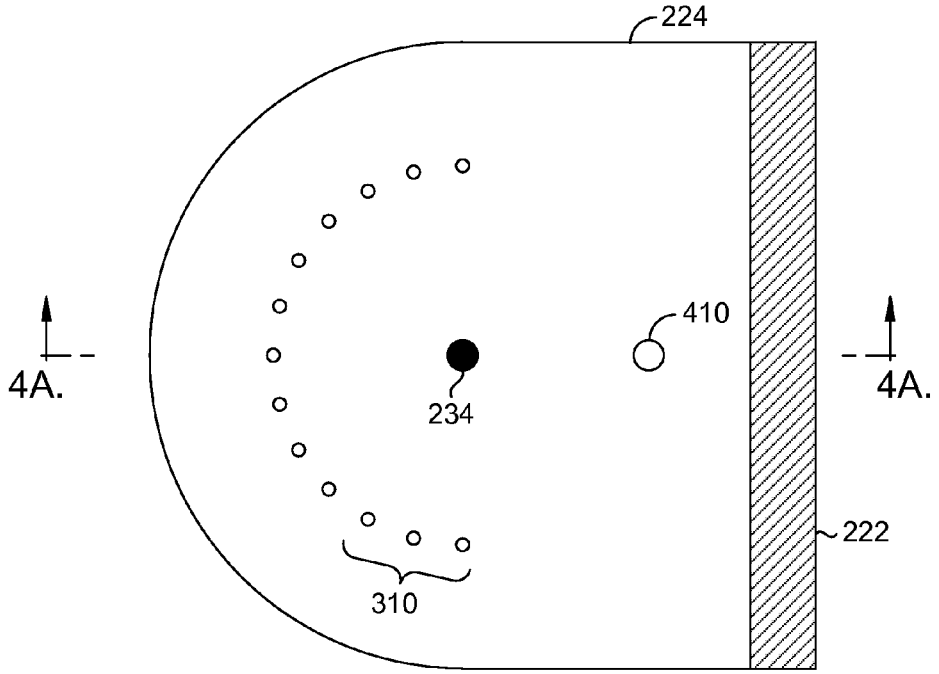
FIG. 4 depicts a top plan view of a receiving plate of an exemplary movable bracket assembly of the antenna mounting bracket of FIG. 2 illustrating a set of receiving apertures and a rotation limiting pin suitable for practicing an embodiment of the technology.

Turning now to FIGS. 3-4, these figures depict a top plan view of the top surface of the receiving plate 224 of the movable bracket assembly 212 of FIG. 2. With respect to FIG. 3, FIG. 3 depicts one embodiment of the receiving plate 224 that includes a set of receiving apertures 310, an aperture containing the pivot rod 234, and a rotation limiting channel 312. The receiving plate 224 may generally have the shape depicted in FIG. 3 and have dimensions of approximately 10 inches by 10 inches, although other shapes and/or dimensions are contemplated as being within the scope of the invention.

The set of receiving apertures 310 may include anywhere from 12 to 20 holes arranged generally in a semi-circle around the pivot rod 234 on the back-facing side of the receiving plate 224 (the side opposite the front plate 222). Each aperture 310 is offset from its neighbor aperture 310 by two to five degrees. Further, each aperture 310 is adapted to receive a locking pin, such as the locking pin 220 of FIG. 2, when the locking pin is in the first engaged position. The receiving apertures 310 may extend through the full thickness of the receiving plate 224 in one aspect, or the receiving apertures 310 may extend approximately partway through the thickness of the receiving plate 224.

As shown in FIG. 3, the rotation limiting channel 312 is in a generally semi-circular shape centered on the pivot rod 234 and is positioned on the front-facing side of the receiving plate 224 (the side of the plate 224 adjacent to the front plate 222) opposite of the set of receiving apertures 310. The rotation limiting channel 312 may extend through the full thickness of the receiving plate 224, or the rotation limiting channel 312 may extend partially through the thickness of the receiving plate 224. Any and all such variations, and any combination thereof, are contemplated as being within the scope of the invention. The rotation limiting channel 312 is adapted to receive a rotation limiting pin located on, for example, the bottom surface of the locking pin plate 216 of the fixed bracket assembly 210. The interaction of the rotation limiting channel 312 with the rotation limiting pin of the locking pin plate 216 acts to restrict the angular rotation of the movable bracket assembly 212 to a predefined range such as, for example, a 30-45 degree range.

Figure 3A:
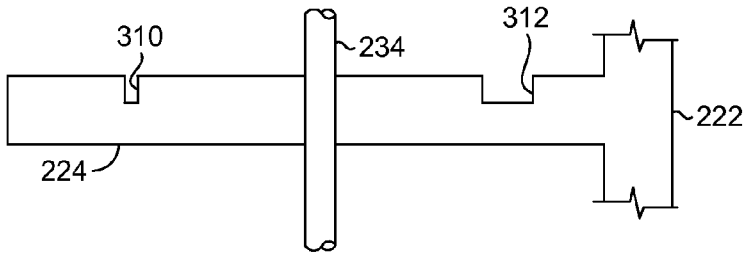
FIG. 3A depicts a side plan view of the receiving plate of the movable bracket assembly of FIG. 3 taken along cut line 3A-3A of FIG. 3 suitable for practicing an embodiment of the technology.

FIG. 3A depicts a cross-section of the receiving plate 224 taken along cut line 3A-3A of FIG. 3. FIG. 3A includes the receiving aperture 310, the pivot rod 234, and a cross-section of the rotation limiting channel 312. As shown in FIG. 3A, the receiving aperture 310 and the rotation limiting channel 312 are shown as extending partially through the thickness of the receiving plate 224 beginning at the top surface of the receiving plate 224. In other aspects, the receiving aperture 310 and/or the rotation limiting channel 312 may extend through the full thickness of the receiving plate 224.

With respect to FIG. 4, FIG. 4 depicts another embodiment of the receiving plate 224 that includes the set of receiving apertures 310, the aperture containing the pivot rod 234, and a rotation limiting pin 410. The discussion regarding the set of receiving apertures 310 is the same as FIG. 3. The rotation limiting pin 410 is located on the front-facing side of the receiving plate 224 and is generally situated on a midline of the receiving plate 224. The rotation limiting pin 410 is adapted to be received into a rotation limiting channel located on, for example, the bottom surface of the locking pin plate 216 of the fixed bracket assembly 210. The interaction of the rotation limiting pin 410 with the rotation limiting channel of the locking pin plate 216 acts to restrict the angular rotation of the movable bracket assembly 212 to a predefined range such as, for example, a 30-45 degree range.

Figure 4A:
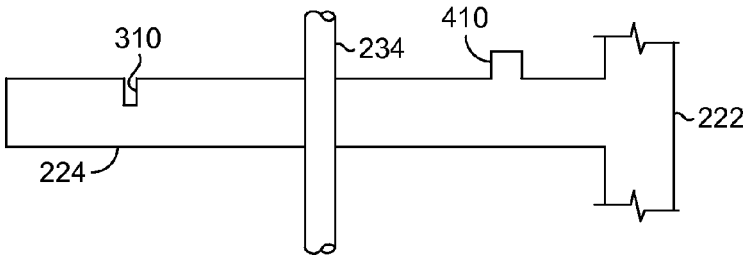
FIG. 4A depicts a side plan view of the receiving plate of the movable bracket assembly of FIG. 4 taken along cut line 4A-4A of FIG. 4 suitable for practicing an embodiment of the technology.

FIG. 4A depicts a cross-section of the receiving plate 224 taken along cut line 4A-4A of FIG. 4. FIG. 4A includes the receiving aperture 310, the pivot rod 234, and a cross-section of the rotation limiting pin 410. The rotation limiting pin 410 is shown as projecting upward a short distance from the top surface of the receiving plate 224.

Figure 5:
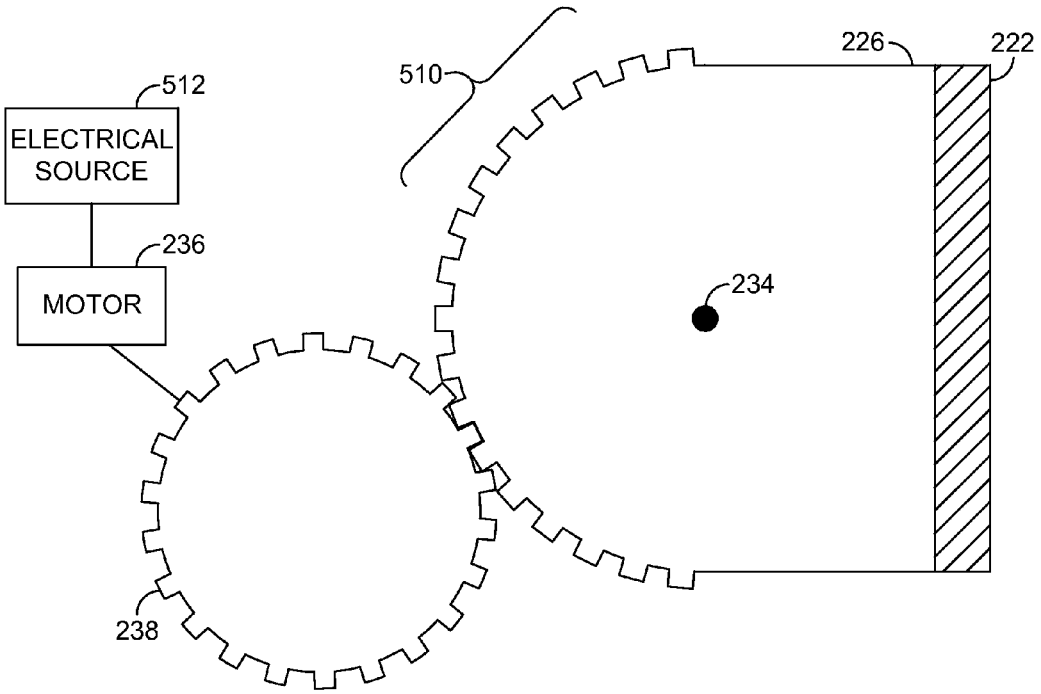
FIG. 5 depicts a top plan view of a rotation actuation plate of a movable bracket assembly of the antenna mounting bracket of FIG. 2 illustrating a gearbox assembly for angularly rotating the movable bracket assembly along a horizontal plane suitable for practicing an embodiment of the technology.

FIG. 5 depicts a top plan view of the top surface of the rotation actuation plate 226 of the movable bracket assembly 212 of FIG. 2 and further depicts one possible arrangement of a gearbox assembly mechanically coupled to the rotation actuation plate 226. The gearbox assembly comprises the motor 236, the gear 238, and an electrical source 512. The gearbox assembly may be mounted on a plate extending from, for example, the back plate 214 of the fixed bracket assembly 210. Mounting may occur by, for instance, screws, welding, rivets, and the like.

As seen in FIG. 5, the back-facing side of the rotation actuation plate 226 (the side opposite the front plate 222) comprises a series of gear teeth 510. The gear teeth 510 may extend along the entire back-facing side as shown in FIG. 5, or the gear teeth 510 may extend along a portion of the back-facing side. Any and all such aspects are contemplated as being within the scope of the invention. The gear teeth 510 mesh with the teeth of the gear 238. In turn, the gear 238 is coupled to the motor 236. The motor 236 in one aspect may comprise a 20-*amp* motor powered by the electrical source 512. Additional ways of powering the motor 236 are contemplated as being within the scope of the invention such as, for example, by battery. The application of current to the motor 236 by the electrical source 512 actuates the motor 236, which then causes the gear 238 to rotate, thereby causing the rotation actuation plate 226 to angularly rotate relative to the fixed pivot rod 234. The gear 238 can be made to rotate in a clockwise direction and in a counterclockwise direction. Clockwise rotation of the gear 238 causes the rotation actuation plate 226 to angularly rotate in a first direction, and counterclockwise rotation of the gear 238 causes the rotation actuation plate 226 to angularly rotate in a second opposite direction. The rotation actuation plate 226 is generally configured to angularly rotate up to 15-25 degrees in 2 to 5 degree increments in the first direction and 15-25 degrees in 2 to 5 degree increments in the second direction with a total range of motion of approximately 30 to 45 degrees. Other arrangements of gearbox assemblies are known and contemplated as being within the scope of the invention.

Figure 6:
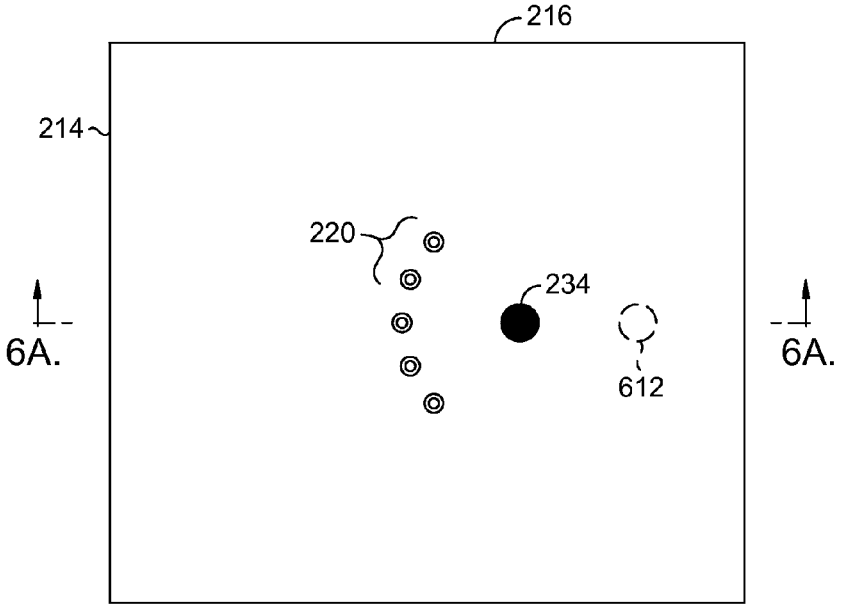
FIG. 6 depicts a top plan view of a locking pin plate of an exemplary fixed bracket assembly of the antenna mounting bracket of FIG. 2 illustrating locking pins and a hidden rotation limiting pin illustrated by dashed lines suitable for practicing an embodiment of the technology.
Figure 7:
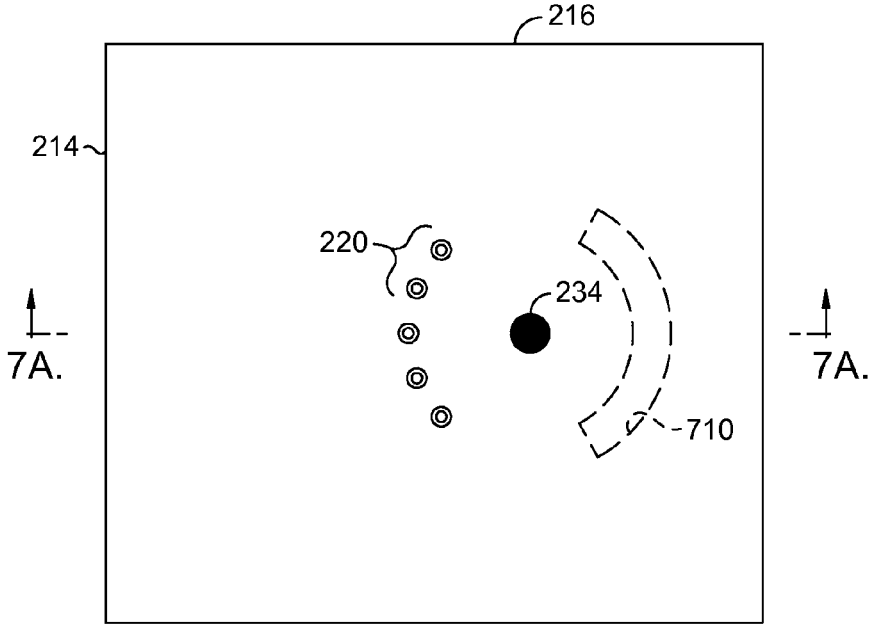
FIG. 7 depicts a top plan view of a locking pin plate of an exemplary fixed bracket assembly of the antenna mounting bracket of FIG. 2 illustrating locking pins and a hidden rotation limiting channel illustrated by dashed lines suitable for practicing an embodiment of the technology.

FIGS. 6-7 depict a top plan view of the top surface of the locking pin plate 216 of the fixed bracket assembly 210 of FIG. 2. With respect to FIG. 6, FIG. 6 depicts one embodiment of the locking pin plate 216 that includes the movable locking pins 220, an aperture containing the pivot rod 234, and a hidden view of a rotation limiting pin 612 shown by the dashed lines. The locking pin plate 216 may generally have the shape depicted in FIG. 6 and have dimensions of approximately 10 inches by 10 inches, although other shapes and dimensions are contemplated as being within the scope of the invention.

The movable locking pins 220 may include anywhere from three to five locking pins arranged generally in a semi- or quarter-circle in relation to the pivot rod 234. The locking pins 220 are located at the back-facing side of the locking pin plate 216 (e.g., towards the back plate 214). Each locking pin 220 is offset from its neighboring locking pin 220 by approximately two to five degrees. The locking pins 220 extend through the full thickness of the locking pin plate 216. The head of the locking pin 220 may have a slightly larger diameter than the body of the locking pin 220 thereby helping to secure the locking pin 220 to the locking pin plate 216 when the locking pin 220 is in the first engaged position.

The rotation limiting pin 612 is located on the bottom surface of the locking pin plate 216 and is generally situated on a midline of the locking pin plate 216 opposite the locking pins 220. The rotation limiting pin 612 is adapted to be received into a corresponding rotation limiting channel, such as the rotation limiting channel 312 of FIG. 3, located on, for example, the top surface of the receiving plate 224 of the movable bracket assembly 212. The interaction of the rotation limiting pin 612 with the rotation limiting channel of the receiving plate 224 acts to restrict the angular rotation of the movable bracket assembly 212 to a predefined range such as, for example, a 30-45 degree range.

Figure 6A:
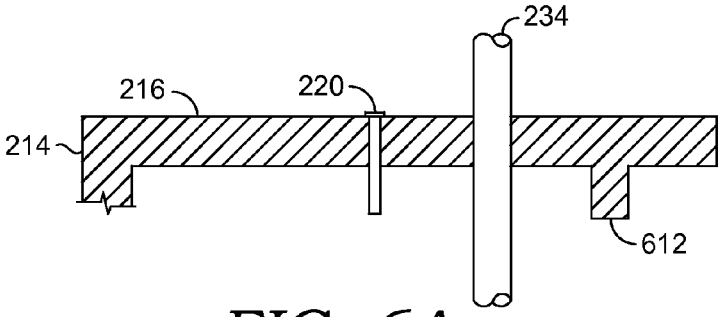
FIG. 6A depicts a side plan view of the locking pin plate of the fixed bracket assembly of FIG. 6 taken along cut line 6A-6A of FIG. 6 illustrating a locking pin in an engaged position suitable for practicing an embodiment of the technology.
Figure 6B:
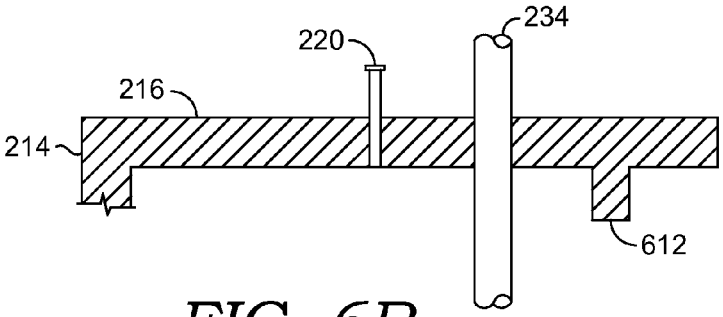
FIG. 6B depicts the side plan view of the locking pin plate of the fixed bracket assembly of FIG. 6A illustrating the locking pin in a disengaged position suitable for practicing an embodiment of the technology.

FIG. 6A depicts a cross-section of the locking pin plate 216 along cut line 6A-6A of FIG. 6. FIG. 6A depicts the locking pin 220 in a first engaged position (the other locking pins 220 shown in FIG. 6 are not shown for clarity's sake). In the first engaged position, the head of the locking pin 220 is situated nearly flush with the top surface of the locking pin plate 216 and the body of the locking pin 220 extends a distance below the bottom surface of the locking pin plate 216. FIG. 6A further depicts the rotation limiting pin 612 extending vertically downward a short distance from the bottom surface of the locking pin plate 216. FIG. 6B depicts the locking pin 220 of FIG. 6A in the second disengaged position. In this position, the head of the locking pin 220 is positioned a distance vertically above the top surface of the locking pin plate 216, and the end of the locking pin 220 is located generally flush with the bottom surface of the locking pin plate 216. It is further contemplated, that the end of the locking pin 220 may extend slightly vertically below the bottom surface of the locking pin plate 216 or be retracted into the actual aperture containing the locking pin 220. Any and all such aspects, and any variation thereof, are contemplated as being within the scope of the invention.

FIG. 7 depicts an alternative embodiment of the top surface of the locking pin plate 216 of the fixed bracket assembly 210 of FIG. 2 that includes the locking pins 220, the pivot rod 234, and a hidden rotation limiting channel 710 shown by the dashed lines. The discussion of the locking pins 220 is the same as that set forth in FIG. 6. The rotation limiting channel 710 is located on the bottom surface of the locking pin plate 216. It is generally semi-circular in shape centered on the pivot rod 234 and positioned on the front-facing side of the locking pin plate 216 opposite the locking pins 220. The rotation limiting channel 710 may extend through the full thickness of the locking pin plate 216, or the rotation limiting channel 712 may extend partially through the thickness of the locking pin plate 216. Any and all such variations, and any combination thereof, are contemplated as being within the scope of the invention. The rotation limiting channel 710 is adapted to receive a rotation limiting pin, such as the rotation limiting pin 410 of FIG. 4, located on, for example, the top surface of the receiving plate 224 of the movable bracket assembly 212. The interaction of the rotation limiting channel 710 with the rotation limiting pin of the movable bracket assembly 212 acts to restrict the angular rotation of the movable bracket assembly 212 to a predefined range such as, for example, a 30-45 degree range.

Figure 7A:
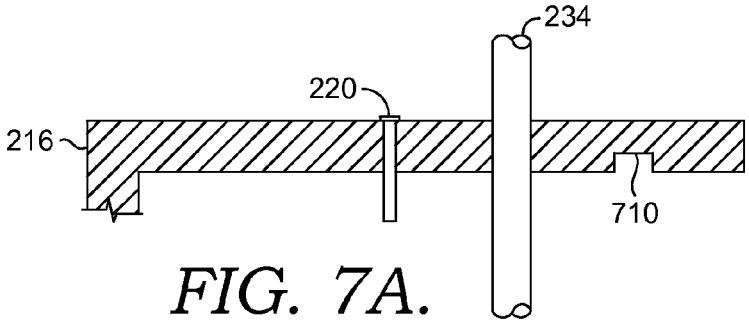
FIG. 7A depicts a side plan view of the locking pin plate of the fixed bracket assembly of FIG. 7 taken along cut line 7A-7A of FIG. 7 illustrating a locking pin in an engaged position suitable for practicing an embodiment of the technology.
Figure 7B:
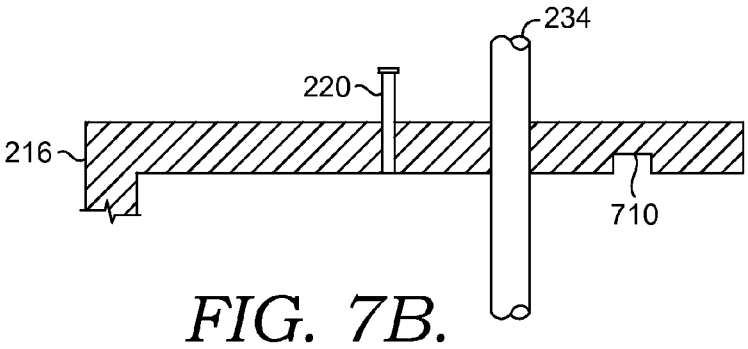
FIG. 7B depicts the side plan view of the locking pin plate of the fixed bracket assembly of FIG. 7A illustrating the locking pin in a disengaged position suitable for practicing an embodiment of the technology.

FIG. 7A depicts a cross-section of the locking pin plate 216 taken along cut line 7A-7A of FIG. 7. FIG. 7A depicts the locking pin 220 in the first engaged position as described with respect to FIG. 6A. Like FIG. 6A, the other locking pins 220 are not shown for clarity's sake. FIG. 7A further depicts a cross-sectional view of the rotation limiting channel 710. As seen in FIG. 7A, the rotation limiting channel 710 is located on the bottom surface of the locking pin plate 216 and extends partially through the thickness of the locking pin plate 216. FIG. 7B depicts the locking pin 220 of FIG. 7A in the second disengaged position as described above with respect to FIG. 6B.

Figure 8:
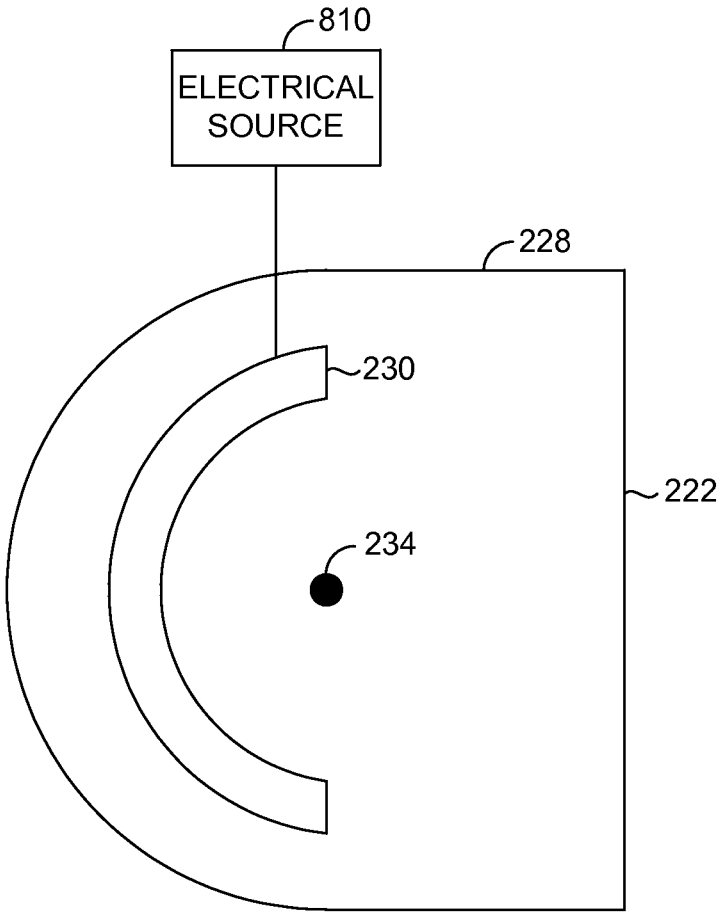
FIG. 8 depicts a top plan view of an exemplary locking pin receiving plate of a movable bracket assembly of the antenna mounting bracket of FIG. 2 suitable for practicing an embodiment of the technology.

FIG. 8 depicts a top plan view of the top surface of the locking pin receiving plate 228 of FIG. 2. The locking pin receiving plate 228 includes the aperture through which the pivot rod 234 extends, the electromagnet 230, and an electrical source 810. The electromagnet 230 is generally semi-circular in shape and centered on the pivot rod 234; it is located on the back-facing side of the locking pin receiving plate 228. The shape of the electromagnet 230 generally corresponds to the generally semi-circular arrangement of the locking pins 220 as shown in FIGS. 6-7. Upon application of current to the electromagnet 230 by the electrical source 810, the electromagnet 230 becomes magnetized and acts to transition the locking pins 220 from the first engaged position to the second disengaged position. This is further depicted in FIGS. 9A-9B.

As described above, instead of the electromagnet 230, the locking pin receiving plate 228 may include a vacuum plate having the same general shape as the electromagnet 230. The vacuum plate may be coupled to a vacuum generator that generates a vacuum force. The vacuum plate distributes the vacuum force via one or more apertures located on the lower surface of the vacuum plate (e.g., the surface adjacent to the heads of the locking pins 220). Upon application of an electrical current to the vacuum generator, the vacuum plate exerts an upward force on the heads of the locking pins 220 causing them to transition from the first engaged position to the second disengaged position. When the electrical current is no longer applied to the vacuum generator, the vacuum force ceases and the locking pins 220 transition from the second disengaged position to the first engaged position.

Figure 9A:
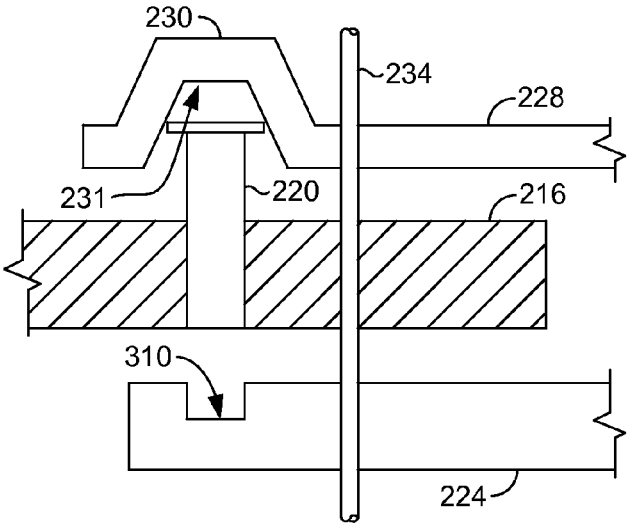
FIG. 9A depicts a side plan view of an exemplary relationship between different plates of the antenna mounting bracket of FIG. 2 when a locking pin is in a disengaged position suitable for practicing an embodiment of the technology.

FIG. 9A depicts an exemplary arrangement of the locking pin receiving plate 228, the locking pin plate 216, and the receiving plate 224 when the locking pin 220 is in the second disengaged position. The locking pin 220 may be in the second disengaged position subsequent to an electrical current being applied to, for example, the electromagnet 230 via the electrical source 810. Once the current is applied to the electromagnet 230, the electromagnet 230 exerts an upward force on the head of the locking pin 220 causing the head of the locking pin 220 to be drawn upward into the cavity 231 located on the bottom surface of the locking pin receiving plate 228 under the electromagnet 230. In the second disengaged position, the body of the locking pin 220 is no longer received by the receiving aperture 310 of the receiving plate 224, and, instead, is located at a vertical distance above the receiving plate 224. This configuration enables the receiving plate 224 to be rotated without hindrance from the locking pin 220.

Figure 9B:
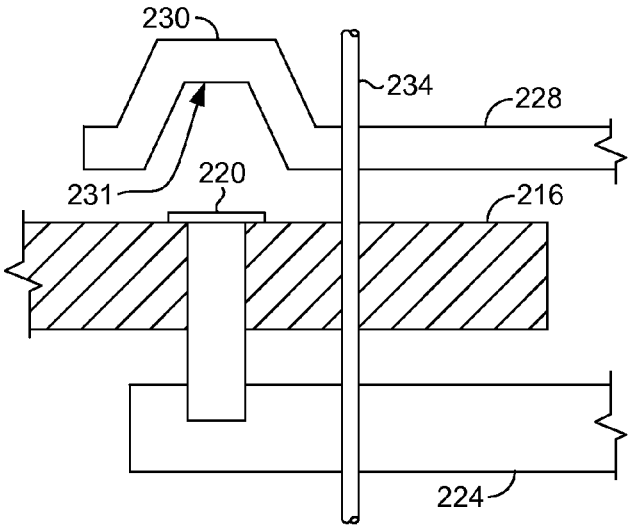
FIG. 9B depicts a side plan view of an exemplary relationship between the different plates of the antenna mounting bracket of FIG. 2 when the locking pin is in an engaged position suitable for practicing an embodiment of the technology.

FIG. 9B depicts the exemplary arrangement of the locking pin receiving plate 228, the locking pin plate 216, and the receiving plate 224 when the locking pin 220 is in the first engaged position. The locking pin 220 may be in the first engaged position subsequent to the electrical source 810 no longer supplying an electrical current to the electromagnet 230. In the first engaged position, the head of the locking pin 220 is no longer received into the cavity 231. Instead, because no upward force is being exerted by the electromagnet 230, the head of the locking pin 220 is generally flush with the top surface of the locking pin plate 216, and the body of the locking pin 220 is engaged with the receiving aperture 310 of the receiving plate 224.

Figure 10:
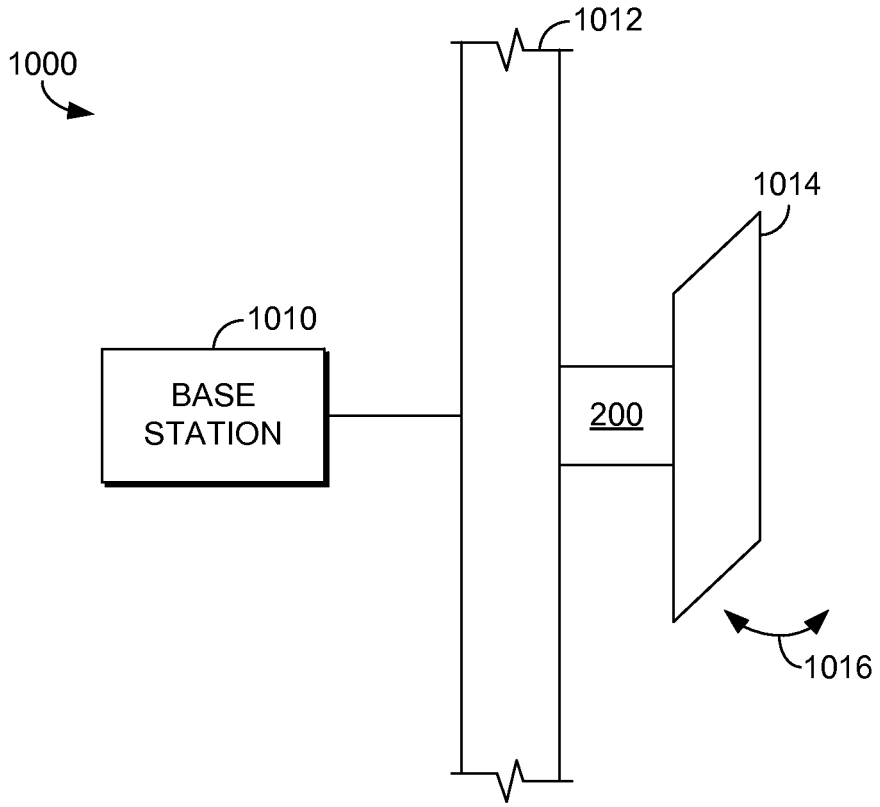
FIG. 10 depicts an exemplary arrangement of a base station, a support structure, an antenna mounting bracket having adjustable azimuth settings, and an antenna suitable for practicing an embodiment of the technology.

FIG. 10 depicts the antenna mounting bracket 200 in an as-used arrangement, referenced generally by the numeral 1000. FIG. 10 includes a support structure 1012 associated with a base station 1010, and an antenna 1014 mounted to the support structure 1012 using the antenna mounting bracket 200. The support structure 1012, in one aspect, may be associated with a platform mounted on the base station 1010. The platform may include multiple support structures used to mount multiple antennas.

As seen in FIG. 10, the antenna mounting bracket 200 mounts the antenna 1014 to the support structure 1012. When the antenna mounting bracket 200 is adjusted to a new azimuth setting, the antenna 1014 is subsequently also adjusted to a new azimuth setting because it is fixed to the antenna mounting bracket 200. The bidirectional arrow 1016 indicates that the antenna 1014 can be angularly rotated in a first horizontal direction and in a second opposite horizontal direction to achieve different azimuth settings.

Figure 11:
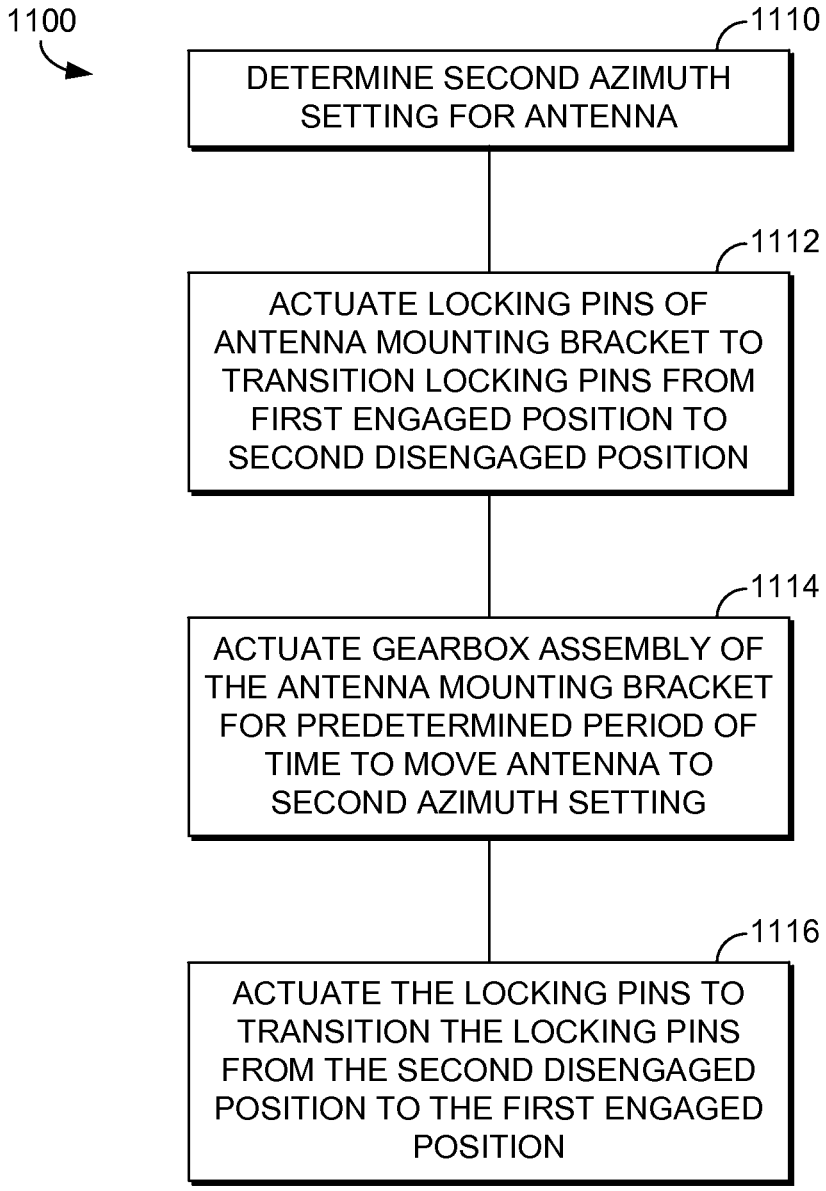
FIG. 11 depicts a flow diagram of an exemplary method of remotely regulating the azimuth setting of an antenna using an antenna mounting bracket with adjustable azimuth settings in accordance with an embodiment of the technology.

Turning now to FIG. 11, FIG. 11 is a flow diagram of an exemplary method 1100 of automatically and without human intervention changing the azimuth setting of an antenna mounted to a support structure, such as a base station, using an antenna mounting bracket having adjustable azimuth settings. The method 1100 may be carried out, for example, by a computing device, such as the computing device 150 of FIG. 1. The computing device may be associated with the support structure, or the computing device may be located remote to the support structure. The ability to remotely change the azimuth setting of an antenna using the computing device eliminates the need for technicians to climb the support structure and manually change the azimuth of the antenna.

The antenna mounting bracket with adjustable azimuth settings may comprise the antenna mounting bracket 200 discussed above with respect to FIGS. 2-10. As such, the antenna mounting bracket may comprise a fixed bracket assembly, such as the fixed bracket assembly 210 of FIG. 2 that is fixedly secured to the support structure. The fixed bracket assembly is rotatably coupled to a movable bracket assembly, such as the movable bracket assembly 212 of FIG. 2, by a pivot rod, such as the pivot rod 234 of FIG. 2. The antenna is securely attached to the movable bracket assembly. The fixed bracket assembly includes at least a set of locking pins such as the locking pins 220 of FIG. 2, and the movable bracket assembly includes at least a set of receiving apertures such as the receiving apertures 310 of FIG. 3. The receiving apertures are configured to receiving the locking pins when the locking pins are in a first engaged position such as shown in, for example, FIG. 9B.

At a step 1110, a second azimuth setting is determined for the antenna by the computing device. The second azimuth setting is different from the current azimuth setting of the antenna. A new azimuth setting may be determined for the antenna in response to, for example, the need to establish a different serving cell pattern for the antenna. By way of illustrative example, the base station to which the antenna is mounted may be located geographically close to a large concert venue. The antenna in question may initially be positioned facing away from the concert venue. In response to an upcoming concert having a large number of cell users in attendance, a new azimuth setting may be determined for the antenna that enables it to better target these users.

At a step 1112, the set of locking pins is automatically and without human intervention actuated to transition the locking pins from the first engaged position to a second disengaged position. As explained above, the locking pins are in the second disengaged position when they are no longer engaged with the receiving apertures of the movable bracket assembly. In one aspect, the set of locking pins may be actuated by applying an electrical current to an electromagnet positioned vertically above the heads of the locking pins, such as the electromagnet 230 of FIG. 2. Application of current to the electromagnet causes the electromagnet to magnetize and exert an upward force on the heads of the locking pins sufficient to disengage the locking pins from the receiving apertures and draw them vertically upward. Other ways of actuating the locking pins are contemplated as being within the scope of the invention such as, for example, applying a suction force to the heads of the locking pins via a vacuum plate coupled to a vacuum generator.

At a step 1114, a gearbox assembly mechanically coupled to the movable bracket assembly is actuated by the computing device for a predetermined time and in a predetermined direction. Actuation of the gearbox assembly, such as the gearbox assembly shown in FIG. 5, angularly rotates the movable bracket assembly in a first horizontal direction a certain number of degrees relative to the pivot rod to the second azimuth setting. The movable bracket assembly can be angularly rotated in two to five degree increments (i.e., the angular distance between neighboring receiving apertures) for a total of 15 to 25 degrees taken from a midline in either direction. Actuation of the gearbox assembly may occur subsequent to the application of an electrical current to a motor of the gearbox assembly for the predetermined period of time.

At a step 1116, the locking pins are actuated to transition the locking pins from the second disengaged position to the first engaged position. Actuation may occur by ceasing to apply current to the electromagnet (or by ceasing to supply a vacuum force to the vacuum plate). Once the current is no longer applied, the electromagnet is no longer magnetic and no longer exerts an upward force on the heads of the locking pins. Because an upward force is no longer exerted, the locking pins fall by virtue of gravity into the receiving apertures of the movable bracket assembly thereby fixing the movable bracket assembly at the second azimuth setting. Because the antenna is fixedly coupled to the movable bracket assembly, the antenna is also fixed at the second azimuth setting.

In one aspect, after the locking pins are released from the electromagnet, an electrical current may be applied to the gearbox assembly for a short period of time in order to rotate the movable bracket assembly a short distance in either direction in order to securely seat the locking pins.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An antenna mounting bracket assembly with adjustable azimuth settings for mounting an antenna to a support structure, the antenna mounting bracket comprising:

a fixed bracket assembly coupled to the support structure, the fixed bracket assembly comprising at least a set of locking pins movable from a first engaged position to a second disengaged position; and a movable bracket assembly rotatably coupled to the fixed bracket assembly via a pivot rod, the movable bracket assembly comprising at least:

a set of receiving holes adapted to receive the set of locking pins of the outer bracket assembly when the set of locking pins is in the first engaged position, and a gearbox assembly comprising: (1) a plurality of gears; and (2) a motor coupled to the plurality of gears;

wherein actuation of the gearbox assembly rotates the movable bracket assembly relative to the pivot rod along a predetermined angular range or motion on a horizontal plane when the set of locking pins is in the second disengaged position.

2. The antenna mounting bracket assembly of claim 1, wherein the antenna is mounted to the movable bracket assembly.

3. The antenna mounting bracket assembly of claim 2, wherein the movable bracket assembly further comprises an electromagnet that, when activated, is adapted to transition the set of locking pins from the first engaged position to the second disengaged position.

4. The antenna mounting bracket assembly of claim 3, wherein when the electromagnet is de-activated, the set of locking pins is transitioned from the second disengaged position to the first engaged position.

5. The antenna mounting bracket assembly of claim 2, wherein each receiving aperture of the set of receiving apertures is offset from its neighboring receiving aperture by two to five degrees.

6. The antenna mounting bracket assembly of claim 5, wherein the set of receiving apertures comprises between 12 to 20 receiving apertures.

7. The antenna mounting bracket assembly of claim 2, wherein the set of locking pins comprises three to five locking pins.

8. The antenna mounting bracket assembly of claim 2, wherein the angular rotation of the movable bracket assembly is limited to a predefined range.

9. The antenna mounting bracket assembly of claim 8, wherein the predefined range comprises 30 to 45 degrees.

10. The antenna mounting bracket assembly of claim 2, wherein the fixed bracket assembly further comprises a rotation limiting pin and the movable bracket assembly further comprises a rotation limiting channel adapted to receive the rotation limiting pin of the fixed bracket assembly such that the angular rotation of the movable bracket assembly is limited to a predefined range.

11. The antenna mounting bracket assembly of claim 2, wherein the movable bracket assembly further comprises a rotation limiting pin and the fixed bracket assembly further comprises a rotation limiting channel adapted to receive the rotation limiting pin of the movable bracket assembly such that the angular rotation of the movable bracket assembly is limited to a predefined range.

12. The antenna mounting bracket assembly of claim 2, wherein the motor is powered by an electrical source.

13. An antenna mounting bracket assembly with one or more predetermined azimuth settings for mounting an antenna to a support structure, the antenna mounting bracket comprising:

a movable bracket assembly adapted to angularly rotate through the one or more predetermined azimuth settings, the movable bracket assembly comprising at least a set of receiving apertures; and a fixed bracket assembly fixedly coupled to the support structure and rotatably coupled to the movable bracket assembly via a pivot rod, the fixed bracket assembly comprising one or more locking pins movable from a first engaged position to a second disengaged position, the one or more locking pins being vertically adjacent to the set of receiving apertures of the movable bracket assembly, wherein when the one or more locking pins are in the first engaged position they are received by the set of receiving apertures such that the movable bracket assembly is held in a fixed position; and wherein when the one or more locking pins are in the second disengaged position the movable bracket assembly is able to angularly rotate through the one or more predetermined azimuth settings relative to the pivot rod.

14. The antenna mounting bracket assembly of claim 13, wherein the support structure is associated with a base station tower.

15. The antenna mounting bracket assembly of claim 13, wherein the antenna mounting bracket is manufactured using steel.

16. A computerized method carried out by at least one server having at least one processor for automatically and without human intervention changing an azimuth setting of an antenna mounted to a support structure using an antenna mounting bracket assembly having adjustable azimuth settings, the antenna mounting bracket assembly comprising a fixed bracket assembly fixedly coupled to the support structure and rotatably coupled to a movable bracket assembly via a pivot rod, wherein the fixed bracket assembly comprises at least by a set of movable locking pins and the movable bracket assembly comprises at least a set of receiving apertures adapted to receive the set of locking pins when the set of locking pins is in a first engaged position, and wherein the antenna is fixedly coupled to the movable bracket assembly, the method comprising:

determining a second azimuth setting for the antenna, wherein the antenna is currently at a first azimuth setting;

actuating the set of locking pins to transition the set of locking pins from the first engaged position to a second disengaged position such that the set of locking pins is disengaged from the set of receiving apertures;

actuating a gearbox assembly mechanically coupled to the movable bracket assembly for a predetermined period of time such that the movable bracket assembly is angularly rotated in a first direction relative to the pivot rod, the movable bracket assembly angularly rotated to the second azimuth setting; and actuating the set of locking pins to transition the set of locking pins from the second disengaged position to the first engaged position thereby fixing the antenna at the second azimuth setting.

17. The method of claim 16, wherein actuating the set of locking pins to transition the set of locking pins from the first engaged position to the second disengaged position comprising providing an electrical current to an electromagnet positioned vertically above the set of locking pins and coupled to the movable bracket assembly.

18. The method of claim 17, wherein actuating the set of locking pins to transition the set of locking pins from the second disengaged position to the first engaged position comprising ceasing to provide the electrical current to the electromagnet.

19. The method of claim 16, wherein the gearbox assembly comprises:

(1) a plurality of gears; and 2) a motor coupled to the plurality of gears.

20. The method of claim 19, wherein actuating the gearbox assembly comprises applying an electrical current to the motor.

* * * * *